United States Patent [19]

Remington

[11] 4,346,141

[45] Aug. 24, 1982

[54] IODINE-SUBSTITUTED POLYFLUOROALKYL ESTERS AND THEIR USE

[75] Inventor: William R. Remington, Wilmington, Del.

[73] Assignee: E. I. Du Pont de Nemours and Company, Wilmington, Del.

[21] Appl. No.: 249,224

[22] Filed: Mar. 30, 1981

Related U.S. Application Data

[63] Continuation of Ser. No. 149,576, May 14, 1980, abandoned.

[51] Int. Cl.[3] ..... D04H 1/58

[52] U.S. Cl. ..... 428/289; 427/394; 427/393.4; 428/96; 428/245; 560/83; 560/111; 560/125; 560/223; 560/266

[58] Field of Search ..... 560/223, 266, 83, 111, 560/125; 427/390 E, 394, 393.4; 428/96, 245, 289

[56] References Cited

U.S. PATENT DOCUMENTS

| | | | |
|---|---|---|---|
| 3,031,335 | 4/1962 | Segal et al. | 427/394 |
| 3,719,448 | 3/1973 | Chance et al. | 427/394 |
| 3,854,871 | 12/1974 | Eanzel | 427/393.4 |
| 4,029,585 | 6/1977 | Dettre | 427/372.2 |
| 4,076,870 | 2/1978 | Yamamoto | 427/394 |
| 4,219,625 | 8/1980 | Ingres | 427/393.4 |

OTHER PUBLICATIONS

Brace, "Radical Addition of Iodoperfluoroalkanes to Vinyl and Allyl Monomers", J. Org. Chem. 27, 3033–3088, (1962).

*Primary Examiner*—John D. Smith
*Assistant Examiner*—Janyce H. Bell

[57] ABSTRACT

Compounds having the formula:

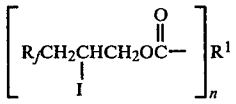

(I)

wherein $R_f$ is perfluoroalkyl containing 4–20 carbons;

$R^1$ is the hydrocarbon residue of either citric, phthalic (o, m or p isomer), benzoic, succinic, chlorendic, trimellitic or pyromellitic acid; and n is a number from 1 to 4, preferably 2 to 4.

Process of using compounds (I) to treat (a) textile materials so as to give them dry soil resistance and oil and water repellency, and (b) paper so as to make it repel water and oil.

22 Claims, No Drawings

IODINE-SUBSTITUTED POLYFLUOROALKYL ESTERS AND THEIR USE

This is a continuation of application Ser. No. 149,576, filed May 14, 1980, now abandoned.

BACKGROUND OF THE INVENTION

1. Field of the Invention

This invention relates to iodine-substituted polyfluoroalkyl esters of polybasic acids and their use in treating a variety of substrates, such as textile fabrics and paper, so as to provide the substrate with soil resistance as well as water and oil repellency.

2. Description of the Prior Art

In recent years, polymers and other compounds containing highly fluorinated segments have been used widely for imparting dry soil resistance as well as oil and water repellency to textile substrates. A degree of resistance to dry, traffic-caused soiling in carpets prepared from synthetic fibers (such as polyesters, polyamides, polyacrylics) is said to be provided by fluoropolymeric coatings, e.g., polymers of perfluoroalkyl acrylates and methacrylates.

Because such synthetic fibers coated with a fluoropolymer may support the advance of a flame more readily than an uncoated synthetic fiber, highly fluorinated mono- and polycarboxylic acid esters have been used to provide dry soil resistance and resistance to burning; U.S. Pat. Nos. 3,923,715 and 4,029,585.

U.S. Pat. No. 3,716,401 discloses and claims a process for rendering a vinyl surface oil resistant by applying thereto a polymeric composition containing a vinyl polymer dissolved in a volatile solvent and an ester derived from perfluoroethanol and a mono- or polycarboxylic acid.

Although its disclosure and claims do not otherwise contemplate such a compound, U.S. Pat. No. 3,145,222 also discloses the compound, $C_3F_7CH_2CHICH_2O_2CCH_3$, and indicates it may be hydrolyzed and treated with alkali to give a polyfluoroepoxy polymer intermediate.

U.S. Pat. No. 3,763,282 discloses compounds of the general formula

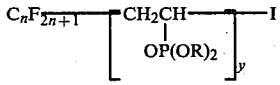

wherein n is an integer from 1 to 10,

R is alkyl, and y is an integer from 1 to 3.

U.S. Pat. No. 3,083,224 discloses polyfluoroalkyl phosphates which are prepared by reacting polyfluoroalkanols with phosphorus oxychloride. The patent discloses that polyfluoroalkanols may be prepared by reacting a perfluoroiodoalkane with an Ω-alkenyl acetate of the following formula, followed by reduction to remove the iodine and hydrolysis to split off the acetyl group:

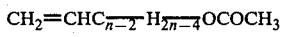

SUMMARY OF THE INVENTION

This invention relates to compounds having the formula:

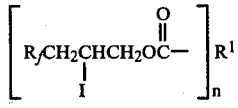

wherein $R_f$ is a fluorinated aliphatic containing at least 3 carbons;

$R^1$ is the hydrocarbon residue of either citric, phthalic (o, m or p isomer), benzoic, succinic, chlorendic, trimellitic or pyromellitic acid; and n is a number from 1 to 4, preferably 2 to 4. It relates also to a process of using compounds of this invention to treat textile materials so as to give them dry soil resistance and oil and water repellency. This invention relates still further to a process for the treatment of paper so as to make it repel water and oil.

DETAILED DESCRIPTION OF THE INVENTION $R_f$ is a saturated, monovalent, non-aromatic, aliphatic radical. The chain may be straight, branched or cyclic, and may be interrupted by divalent oxygen atoms or trivalent nitrogen atoms bonded only to carbon atoms. A fully fluorinated group is preferred, but hydrogen or chlorine atoms may be present as substituents in the fluorinated aliphatic radical provided that not more than one atom of either is present in the radical for every two carbon atoms, and that the radical must at least contain a terminal perfluoromethyl group. In a preferred embodiment, the fluorinated aliphatic radical contains not more than 20 carbon atoms because such a large radical results in inefficient use of the fluorine content. In a more preferred embodiment, $R_f$ is a perfluoroalkyl containing 3 to 20 carbons.

The iodine-substituted polyfluoroalkyl esters of this invention can be prepared by the reaction set forth in the following equation:

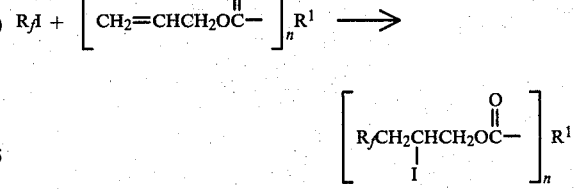

The preparation of the iodine-substituted polyfluoroalkyl ester is carried out in the presence of a free radical initiator at temperatures in the range between about 50° and 140° C. and at pressures between about 1 and 50 atmospheres. If the polyfluoroalkyl iodide or the allyl ester used in the reaction has a boiling point below the desired reaction temperature, a pressure system would be used; otherwise, the reaction may be carried out at atmospheric pressure. The free radical initiator may be either an azo compound or a peroxy compound, e.g., α,α'-azobis-(isobutyronitrile); 2,2'-azobis-(2,4-dimethylvaleronitrile); acetyl peroxide; benzoyl peroxide, di-t-butyl peroxide and the like.

The polyfluoroalkyl iodides can be prepared by a variety of reactions. See for example Brace et al., JACS, 73, 4016 (1951); Krespan, J. Org. Chem., 23, 2016 (1958); Haszeldine, J. Chem. Soc., 1949, 2856; 1952, 4259; 1953, 376; Hauptschein et al., JACS, 79, 2549 (1957).

One of the uses of compounds of this invention involves application of solutions or aqueous dispersions of said compounds to carpets, other woven or non-woven textiles, or paper. The desirable characteristics imparted by the application of said compounds include water repellency, oil repellency, and resistance to soiling. The degree to which said desirable characteristics are achieved is evaluated in different ways for the different substrates. The compounds of this invention are also useful for preparing chloromethyl-substituted polyfluoroalkyl esters described and claimed in Krahler and Remington Application Ser. No. 039,162, filed May 15, 1979, the contents of which are incorporated herein by reference.

In the case of carpets, dry soil resistance provides a measure of the ability of the carpet to retain its new appearance under normal traffic conditions. In addition, oil and water repellency is required in carpets to provide resistance to staining by spilled liquids. In most of the other end uses, achievement of the desired effects is assayed simply by measuring oil and/or water repellency. That may be done by drop tests as reported in Tables 5 and 6.

Application of the novel compounds of this invention from solution or aqueous dispersion to any of the foregoing substrates may be carried out in any known manner so as to deposit on the substrate from about 0.01% to 1.0% of the novel compound, based on the dry weight of the substrate. Preferably, application of the novel compounds of this invention is made from an aqueous dispersion. Subject to the above-defined range of quantities of the novel compounds being deposited on the substrate, the aqueous dispersions of compounds of this invention can be blended with an aqueous polymeric suspension. For example, addition of an aqueous suspension of polymethyl methacrylate makes a composition which can be diluted with water for application to the various substrates contemplated by this invention. The presence of the polymeric suspension, such as an aqueous polymethylmethacrylate, improves dry soil resistance. Such a dispersion, before dilution with water, will normally contain from about 2% to about 20% of fluorinated ester of this invention and between about 2% and about 40% of the polymer, dry basis, provided by the above-mentioned suspension. For application to textile substrates, such as carpets, the above-described dispersion is diluted still further with water. Application can be made by any known technique, such as padding, exhaust spraying, and the like.

After a compound (or compounds) of this invention, as a solution or dispersion and optionally containing other components such as, for example, poly(methylmethacrylate), has been applied to the desired substrate, it will usually be dried to remove water and/or solvent. Normally, drying is effected by heating to about 120°-170° C., although higher or lower temperatures may be used. In particular, drying at ambient temperature is frequently sufficient, although heating is usually preferred to hasten the drying. Furthermore, repellency effects frequently are improved by heat treatment beyond that required for drying. It appears that such treatment at least partially melts the composition of this invention so that it spreads and more effectively coats the substrate.

The oil repellency test used herein is an adaptation of AATCC Test Method 118-1978. Oil repellency is defined as the ability of a substrate to resist wetting by oily liquids. According to the test method, drops of standard test liquids, consisting of a selected series of hydrocarbons with varying surface tensions, are placed on the substrate and observed for wetting. The oil repellency rating is the highest numbered test liquid which will not wet the surface of the substrate within a period of 30 seconds. Wetting of the surface of the substrate is normally evident by a darkening thereof at the interface. On black or dark surfaces, wetting can be detected by a loss of "sparkle" within the drop. The standard test liquids are set forth in Table 1.

TABLE 1

Standard Test Liquids

| Oil Repellency Rating Number | Composition |
|---|---|
| 1 | "Nujol" |
| 2 | 65/35 "Nujol"/n-hexadecane by volume at 70° F. (21° C.) |
| 3 | n-hexadecane |
| 4 | n-tetradecane |
| 5 | n-dodecane |
| 6 | n-decane |
| 7 | n-octane |
| 8 | n-heptane |

"Nujol" is the trademark of Plough, Inc. for a mineral oil having a Saybolt viscosity of 360/390 at 100° F. (38° C.) and a specific gravity of 0.880/0.900 at 60° F. (15° C.).

The water repellency test provides an index of aqueous stain resistance in that, generally, the higher the water repellency rating, the better the resistance to staining by water-based substances. Like the oil repellency rating, the water repellency rating is the highest numbered test liquid which will not wet the surface of the substrate in a specified amount of time, in this case 10 seconds. The standard test solutions are those of Table 2.

TABLE 2

Standard Test Solutions

| Water Repellency Rating Number | Composition | | Flash Point (TCC) | |
|---|---|---|---|---|
| | % Isopropanol* | % $H_2O$** | °C. | °F. |
| 1 | 2 | 98 | — | — |
| 2 | 5 | 95 | 50 | 122 |
| 3 | 10 | 90 | 40 | 104 |
| 4 | 20 | 80 | 28 | 82 |
| 5 | 30 | 70 | 19 | 66 |

*Reagent Grade, percentage by volume
**Distilled

In accordance with the test procedure, one begins with the lowest numbered test liquid (Water Repellency Rating No. 1), and carefully places one drop thereof at each of three locations on the surface of the substrate. If after 10 seconds two of the three drops are still visible in spherical or hemi-spherical form, drops of the next higher numbered test liquid are placed in an adjacent site and observed for 10 seconds. The above-described procedure is continued until at least two of the three drops of the test liquid fail to remain spherical or hemispherical 10 seconds after application.

The following examples are given by way of illustration, not by way of limitation. Unless otherwise indicated, all parts and percentages are by weight; temperatures are expressed in degrees Centigrade and pressures in mm of Hg.

In some of the examples that follow, the term MPI has been used as an abbreviation for Mixed Perfluoroalkyl Iodides of the formula, $C_nF_{2n+1}I$, having the composition given in Table 3.

TABLE 3

| n | Weight % (Approximate) | |
|---|---|---|
| 4 | 1–2 | |
| 6 | 27–28 | |
| 8 | 32–34 | |
| 10 | 20–22 | (average n = 8) |
| 12 | 8–11 | |
| 14 | 4–5 | |
| 16 | 1–2 | |
| >16 | small amounts | |

It is not necessary that mixed perfluoroalkyl iodides be used in making compounds of this invention. In addition, mixed perfluoroalkyl iodides other than the foregoing can be used, e.g., a mixture of the above formula having the composition given in Table 4.

TABLE 4

| n | Weight % (Approximate) | |
|---|---|---|
| 4 | 3 | |
| 6 | 52 | |
| 8 | 30 | (average n = 6) |
| 10 | 11 | |
| 12 | 3 | |
| 14 | 1 | |

In the examples that follow, the term ABI is an abbreviation for 2,2'-azobis-(isobutyronitrile). Moreover, in those examples, the term "deoxygenated" means that the material so treated was stirred overnight at ambient temperature under a current of nitrogen or stirred for at least one hour at about 60° C. under a current of nitrogen. In the examples, "nonionic surfactant" means the product of the reaction of 15 moles of ethylene oxide with 1 mole of a mixture of n-dodecanol-1, n-tetradecanol-1, and n-hexadecanol-1. "Arquad" 18-50 means a 50% solution of octadecyl trimethyl ammonium chloride in water.

EXAMPLE 1

| Preparation of Adduct | |
|---|---|
| MPI | 146 g |
| Triallyl trimellitate | 26.4 g |
| ABI | 1.65 g |

The MPI and the triallyl trimellitate were mixed and deoxygenated. Then, while maintaining a nitrogen atmosphere, the ABI was added portionwise over a period of about 24 hours on the following time schedule:

| Elapsed Time (Hours) | Temperature | ABI Addition |
|---|---|---|
| 0 | 65° C. | 0.2 g |
| 2⅓ | 64° C. | 0.2 g |
| 3 1/12 | 67° C. | 0.2 g |
| 5 5/6* | 64–72° C. | 0.4 g |
| 24 | raised to 99° C. | 0.65 g |
| | Total | 1.65 g |
| 24¾ | reaction terminated | |

| Preparation of Dispersion and Testing on Nylon Carpet | |
|---|---|
| Adduct | 100 g |
| Methylisobutyl ketone | 50 g |
| "Arquad" 18-50 | 6 g |
| Nonionic surfactant | 3 g |
| Water | about 125 g |
| 2-Methyl-2,4-pentanediol | 0.5 g |

*The reaction mass was heated so that the temperature was raised to 72° C.

All components were combined at 50°–80° C. in a blender, agitated therein for about 10 minutes, and then passed twice through a Manton-Gaulin homogenizer (2 stages, 500 and 6000 psi). The methyl isobutyl ketone was then distilled out, along with some water, using a partial vacuum and temperatures up to about 55° C.

A portion of the finished dispersion was diluted with water and mixed with acetic acid and an aqueous dispersion of polymethylmethacrylate (PMMA). The PMMA in the dispersion had an inherent viscosity of about 0.7 (0.5 g of PMMA in 100 ml of acetone at 30° C.), and was made up of particles having an average size of about 0.06 micron. The mixed dispersion comprising the adduct, acetic acid, PMMA and water was then sprayed onto the face of nylon carpet so that the face fibers of the carpet received 0.055% of fluorine (in covalently bound form), 0.186% of polymethylmethacrylate, 0.01% of acetic acid, and about 25% of $H_2O$ based on the weight of the fiber. The carpet was dried for 30 minutes in a forced air oven at 270° F. Samples of the carpet were tested for oil and water repellency. Samples thereof were also tested for dry soil resistance by being placed in a heavily-travelled hallway along with untreated samples of the same carpet, being rated for soil-resistance in comparison with the untreated carpet. The results of testing of the carpet samples are set forth in Table 5.

Another portion of the finished dispersion was diluted with water and mixed with acetic acid. It was then sprayed onto the face of nylon carpet so that the face fibers thereof received 0.055% of fluorine (in covalently bound form), 0.01% of acetic acid and about 25% of water. The treated carpet was then dried and tested as described above, giving the data set forth in Table 6.

EXAMPLE 2

| Preparation of Triallyl Citrate Adduct | |
|---|---|
| MPI | 820 g |
| Triallyl citrate | 161 g |
| ABI | 9.5 g |

The MPI and 47 ml of the triallyl citrate were mixed and deoxygenated overnight. The next day, the following schedule was followed:

| Elapsed Time (min) | Temperature (°C.) | ABI Addition (g) | Triallyl Citrate Addition (ml) |
|---|---|---|---|
| 0 | 25 (heating) | 0.5 | |
| 30 | 64 | | |
| 45 | 62 | | 5 |
| 70 | 65 | | 20 |
| 88 | 65 | | 10 |

-continued

| Elapsed Time (min) | Temperature (°C.) | ABI Addition (g) | Triallyl Citrate Addition (ml) |
|---|---|---|---|
| 96 | 64 | | 10 |
| 125 | 66 | | 15 |
| 146 | 71 | 1.0 | |
| 158 | 72 | | remainder |
| 158–270 | 72–91 | | |
| 330 | 81 | 2.0 | |
| 375 | 81 | 2.0 | |
| 414 | 81 | 4.0 | |
| 441 | 81 | Shut down overnight (cold time not counted) | |
| 441–486 | 88–100 | | |
| 486 | 95 | Reaction terminated | |

Dispersions of the product of this example, with and without polymethyl methacrylate, were prepared by the procedures described in Example 1. Separate portions thereof were applied to carpet samples and recited in Tables 5 and 6.

EXAMPLE 3

| | |
|---|---|
| $C_6F_{13}I$ | 200.7 g |
| Triallyl citrate | 31.2 g |
| Isooctane | 31.2 g |
| 2,2'-azobis-(isobutyronitrile) | 3.3 g |

All of the above ingredients were combined and deoxygenated. Then the mixture was stirred at 67°–74° for 70 minutes, followed by 150 minutes at 70°–75° and then for 80 minutes at 79°–83°. During the first twenty minutes of the period, the reaction was exothermic and required cooling (after initial heating to bring to reaction temperature). Later, heating was again required.

Volatile materials (87 g) were then removed on the steam bath with aspirator vacuum, using a rotary evaporator. The volatile materials consisted of isooctane (25 g) and perfluorohexyl iodide (62 g). Thus, three mole proportions of perfluoroalkyl iodide had been consumed per mole of triallyl citrate, indicating that the structure of the product is:

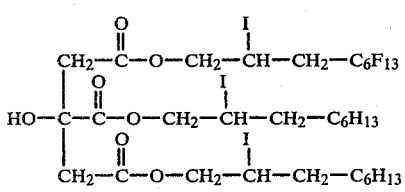

Examination of the product by nuclear magnetic resonance indicated that 94% of the allyl double bonds had been converted to the following structural moiety: $—CF_2—CH_2—CHI—CH_2—$.

The product was dispersed in water and tested on carpet as described in Example 1. The results are set forth in Tables 5 and 6.

EXAMPLE 4

| Preparation of Adduct | |
|---|---|
| MPI | 154 g |
| Diallylphthalate | 34 g |
| ABI | 1.7 g |

The MPI and the diallylphthalate were mixed and deoxygenated. Then, while maintaining a nitrogen atmosphere, the ABI was added and temperature was controlled according to the following schedule:

| Elapsed Time (min) | Temperature (°C.) | ABI Addition |
|---|---|---|
| 0 | heating from 25 | 0.1 g |
| 15 | 60 | |
| 15–43 | 60–68 | |
| 43 | 68 | 0.1 g |
| 59 | 69.5 | 0.2 g |
| 59–85 | 69–76.5 | |
| 85 | 71.5 | 0.3 g |
| 103 | 71 | 0.5 g |
| 103–148 | 69.5–84 | |
| 148 | 79 | 0.5 g |
| 212 | 74.5–100 | |
| 212 | 91 | reaction terminated |

Preparation of Dispersion and Testing on Carpet

This was carried out as described in Example 1 and the results are recorded in Table 5.

EXAMPLE 5

| Preparation of Adduct | |
|---|---|
| MPI | 110 g |
| Allyl benzoate | 32 g |
| ABI | 3.55 g |

The procedure was as described in Example 4, with the following schedule for temperature and addition of ABI.

| Elapsed Time (min) | Temperature (°C.) | | ABI Addition |
|---|---|---|---|
| 0 | 61 | | 0.1 g |
| 54 | 60 | | 0.1 g |
| 122 | 60 | | 0.1 g |
| 198 | 60 | | 0.4 g |
| 303 | 61 | | 0.4 g |
| 720 | 61 | cooled | |
| 0 (after rewarming) | 56 | | |
| 12 | 59 | | 0.4 g |
| 130 | 60 | temperature control reset to 71° | |
| 244 | 71 | | 0.4 g |
| 439 | 71 | | 0.4 g |
| 840 | 72 | cooled | |
| 0 (after rewarming) | 56 | | |
| 45 | 56–80 | | |
| 150 | 80 | | 1.05 g |
| 150–745 | 80–90 | briefly cooled to 58° at 258 | |
| 745 | 90 | reaction terminated | |

Preparation of emulsion and testing on carpet were carried out as described in Example 1 and the results are recorded in Table 5.

EXAMPLE 6

Preparation of the adduct was carried out essentially as described in Example 5, with the following exceptions:

MPI was replaced by $C_8F_{17}I$; and the adduct was purified by recrystallization from isopropanol.

TABLE 5

| Ex. No. | Dry Soil Resistance* (With PMMA) | Oil Repellency (With PMMA) | Water Repellency (With PMMA) |
|---|---|---|---|
| 1 | N-C [a] | 5 | 5 |
| 2 | C-M [a] | 5 | 5 |
| 3 | N-C [a] | 5 | 5 |
| 4 | C | 5 | 5 |
| 5 | N | 0 | 3 |
| Untreated Carpet | — | 0 | 0 |

*Degree of superiority over untreated carpet
E = equal
N = noticeably better
C = considerably better
M = much better
[a] = 0.11% PMMA

TABLE 6

| Ex. No. | Dry Soil Resistance* (Without PMMA) | Oil Repellency (Without PMMA) | Water Repellency (Without PMMA) |
|---|---|---|---|
| 1 | N-C | 5 | 5 |
| 2 | C | 5 | 5 |
| 3 | MW** | 4 | 5 |

*S = slightly better
**MW = much worse

EXAMPLE 7

| Preparation of MPI/Diallyl Isophthalate (DAIP) Adduct | |
|---|---|
| MPI | 8655 g |
| DAIP | 1980 g |
| ABI | 60 g |

All of the MPI was placed in a round-bottom flask, set in a water bath for temperature control. Of the DAIP, 600 ml. were added and the mixture was deoxygenated. The mixture was heated to 72°±3° C., and the following schedule of additions was followed:

| Elapsed Time | ABI Addition (g) | DAIP Addition (ml) |
|---|---|---|
| 0 | 6 | |
| 58 | | 200 |
| 60 | 6 | |
| 89 | | 200 |
| 118 | | 200 |
| 120 | 6 | |
| 178 | | 200 |
| 180 | 6 | |
| 238 | | 200 |
| 240 | 6 | |
| 298 | | remainder |
| 300 | 6 | |
| 360 | 6 | |
| 420 | 6 | |
| 480 | 6 | |
| 540 | 6 | |
| 1410 | temperature raised to 76° (material was partially frozen) | |
| 1410–1450 | temperature gradually raised to 82° to melt product | |
| 1485 | reaction terminated | |

I claim:

1. A compound having the formula:

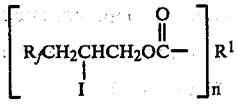

wherein $R_f$ is a fluorinated aliphatic containing at least 3 carbons;

$R^1$ is the hydrocarbon residue of either citric, succinic, chlorendic, trimellitic or pyromellitic acid; and n is a number from 1 to 4.

2. A compound of claim 1 wherein $R_f$ is a perfluoroalkyl containing 3 to 20 carbons and n is 2 to 4.

3. A compound of claim 2 wherein $R^1$ is derived from citric acid.

4. A compound of claim 2 wherein $R^1$ is derived from trimellitic acid.

5. A compound of any one of claims 1 3 and 4 wherein $R_f$ contains 4 to 16 carbons.

6. A compound according to claim 5 wherein $R_f$ has an average value of 6 to 8 carbons.

7. A process for imparting oil- or water-repellency, or dry soil resistance to a substrate which comprises applying to the substrate at least one compound having the formula:

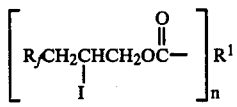

wherein $R_f$ is a fluorinated aliphatic containing at least 3 carbons;

$R^1$ is the hydrocarbon residue of either citric, phthalic (o, m or p isomer), benzoic, succinic, chlorendic, trimellitic or pyromellitic acid; and n is a number from 1 to 4.

8. A process of claim 7 wherein $R_f$ is a perfluoroalkyl containing 3 to 20 carbons and n is 2 to 4.

9. A process of claim 8 wherein $R^1$ is derived from citric acid.

10. A process of claim 8 wherein $R^1$ is derived from o-phthalic acid.

11. A process of claim 8 wherein $R^1$ is derived from isophthalic acid.

12. A process of claim 8 wherein $R^1$ is derived from trimellitic acid.

13. A process of any of claims 7 to 12 wherein $R_f$ contains 4 to 16 carbons.

14. A process of claim 13 wherein $R_f$ has an average value of 6 to 8 carbons.

15. A substrate exhibiting oil- or water-repellency or dry soil resistance and having deposited thereon a compound having the formula:

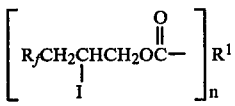

wherein $R_f$ is a fluorinated aliphatic containing at least 3 carbons;

$R^1$ is the hydrocarbon residue of either citric, phthalic (o, m or p isomer), benzoic, succinic, chlorendic, trimellitic or pyromellitic acid; and n is a number from 1 to 4.

16. A substrate of claim 15 wherein $R_f$ is a perfluoroalkyl containing 3 to 20 carbons and n is 2 to 4.

17. A substrate of claim 16 wherein $R^1$ is derived from citric acid.

18. A substrate of claim 16 wherein $R^1$ is derived from o-phthalic acid.

19. A substrate of claim 16 wherein $R^1$ is derived from isophthalic acid.

20. A substrate of claim 16 wherein $R^1$ is derived from trimellitic acid.

21. A substrate of any of claims 15 to 20 wherein $R_f$ contains 4 to 16 carbons.

22. A substrate of claim 21 wherein $R_f$ has an average value of 6 to 8 carbons.

* * * * *